US005513444A

United States Patent [19]

Lindberg

[11] Patent Number: 5,513,444

[45] Date of Patent: May 7, 1996

[54] METHOD AND DEVICE FOR DRYING OF TIMBER

[76] Inventor: Anna-Karin Lindberg, Pl 5940, Söderala, Sweden, S-826 06

[21] Appl. No.: 244,539

[22] PCT Filed: Nov. 28, 1991

[86] PCT No.: PCT/SE91/00809

§ 371 Date: May 27, 1994

§ 102(e) Date: May 27, 1994

[87] PCT Pub. No.: WO93/11397

PCT Pub. Date: Jun. 10, 1993

[51] Int. Cl.[6] ..... F26B 19/00

[52] U.S. Cl. ..... 34/216; 34/217

[58] Field of Search ..... 34/212, 216, 217, 34/218, 219, 209, 210, 500

[56] References Cited

U.S. PATENT DOCUMENTS

| | | | |
|---|---|---|---|
| 4,261,110 | 4/1981 | Northway et al. | 34/217 |
| 4,299,036 | 11/1981 | Schregenberger | 34/210 |
| 4,663,860 | 5/1987 | Beall | 34/216 |

FOREIGN PATENT DOCUMENTS

| | | |
|---|---|---|
| 474071 | 3/1929 | Germany . |
| 11266 | 3/1902 | Norway . |

*Primary Examiner*—Denise L. Gromada
*Assistant Examiner*—Susanne C. Tinker
*Attorney, Agent, or Firm*—Browdy and Neimark

[57] ABSTRACT

A device for drying timber in the form of elongated wood pieces, such as boards or planks, comprises one or more drying rooms and means for introducing dry in-take air into the drying room and evacuate more moist exhaust air therefrom. Several sets of spacing elements are arranged in an individual drying room, said elements being spaced from each other and delimiting a plurality of separate compartments in the drying room. The spacing elements are movable, for instance rotatable, so as to be adjustable between a first position, in which the width of the individual compartment is larger than the thickness of the wood pieces to enable unobstructed in-feed thereof into the compartment, and a second position, in which the width of the compartment has been reduced so far that the spacing elements in two adjacent sets contact and clamp the wood pieces so as to counteract deformation thereof during drying.

20 Claims, 4 Drawing Sheets

METHOD AND DEVICE FOR DRYING OF TIMBER

TECHNICAL FIELD OF THE INVENTION

This invention is related to a method and a device for drying timber, elongated wood pieces, such as boards or planks, being treated with dry warm air during storage in a drying room.

1. Prior Art

In conventional drying of timber, the boards or planks obtained in the saw mill in question are placed on stickers while forming stacks, which are introduced into voluminous drying rooms, in which the stacks are subjected to treatment with dry warm air during a comparatively long time. More specifically, such board stacks are formed by a plurality of horizontally lying layers of boards, said layers being separated from each other by means of so called stickers in the form of long, narrow and non-expensive wood battens, which are orientated substantially perpendicularly to the boards. In each of the various board layers, the boards are placed at a certain distance to each other, so that the individual boards may be surrounded by the dry treatment air not only via the horizontal air gaps formed by the stickers but also via the spaces between adjacent boards in each layer. When the individual board stack has been located in the drying room sufficiently long to reduce the moisture content to a desired level, the stack is removed and transferred to a packaging station, where the stack is taken apart and the boards are arranged in layers immediately adjacent each other in packages surrounded by bands and often protected by plastic wrappings, whereas the stickers, to the extent that the same still are intact and useful, are transferred back to the sawmill for repeated sticking.

2. Disadvantages Associated to the Prior Art

One of several serious disadvantages in connection with the drying technique reflected hereinabove is that the boards in the uppermost layers of the stacks often is deformed during the drying process in view of the natural inherent tendency of the sawn-out wood piece to adopt, on heat treatment, the shape of growth of the tree, from which the board has been recovered. The boards in the uppermost layers of the stack are not influenced by the weight of any above-lying boards but may move more or less freely. This means that deformation during heat treatment may occur unrestrictedly in these board layers. The boards which are deformed in this way and which either has to be discarded or classified into a more non-expensive price class may form 2–10% of the entire contents of boards in the stack; this represents considerable economical losses.

Another disadvantage with the known drying technique is the need for providing stickers in the board stacks. Even if the formation of the stack before drying as well as the disintegration thereof after drying nowadays often is mechanised, both of these work operations are time and cost consuming. A considerable cost occurs in this connection due to the fact that the weak stickers easily break during the handling and must be replaced with new ones. The fact that the stickers are weak causes, for the rest, also that the air gaps between board layers in the stack become relatively narrow. This involves the consequence that drying air only with difficulty may flow through the stack. In other words rapid circulation of air through the stack is hampered.

A further disadvantage with the prior art is the bad usage of the heat energy required for carrying out drying. Although present modern drying devices are provided with heat exchangers of various natures for recovering heat energy from the moist exhaust air evacuated from the drying room, the drying devices consume, all the same, considerable amounts of energy, not only as a consequence of the peer circulation of air through the board stacks but also as a consequence of a lot of energy being wasted in the voluminous spaces occurring between the stacks subjected to drying. As a further example on the waste of energy which occurs it can be mentioned that the board stack when completely dried is taken out of the device immediately after completion of the drying and is placed outdoors to cool prior to packaging. The boards in the stack contain in this condition large amounts of energy which only disappear in the open air.

SUMMARY OF THE CONCEPT OF THE INVENTION

A basic object of the present invention is to provide a drying method and a drying device allowing drying of wood pieces in the form of boards or planks without deformation thereof. Another object is to eliminate the need for sticking and thereby enable a rapid and efficient handling of the wood pieces in the processing chain between a sawmill and a packaging station present after the drying device. A further object is to reduce the energy requirement in connection with execution of the drying.

These objects are achieved by means of the method and the device defined in the appendant claims.

BRIEF DESCRIPTION OF ENCLOSED DRAWINGS

DETAILED DESCRIPTION OF A PREFERRED EMBODIMENT OF THE INVENTION

Figure 1:
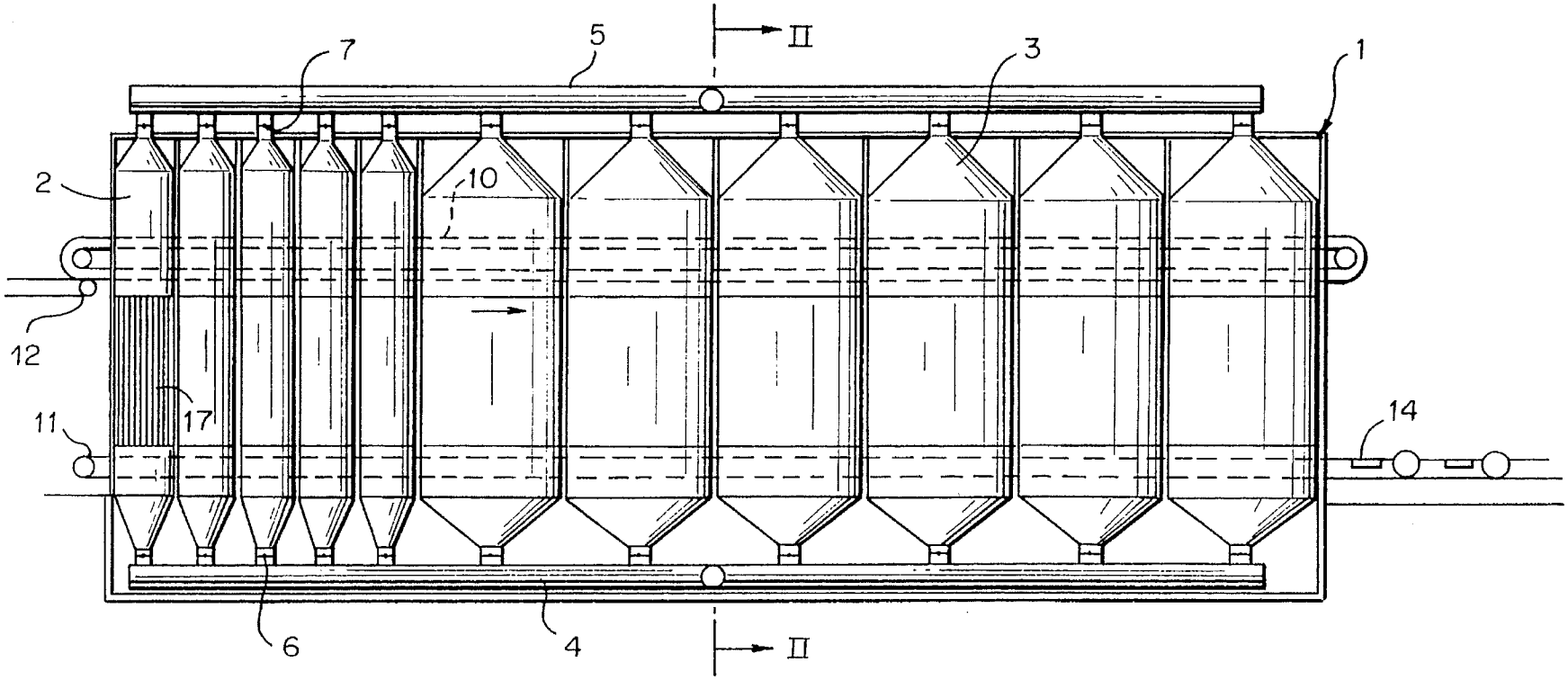
FIG. 1 is a diagrammatical longitudinal section through a device according to the invention.
Figure 2:
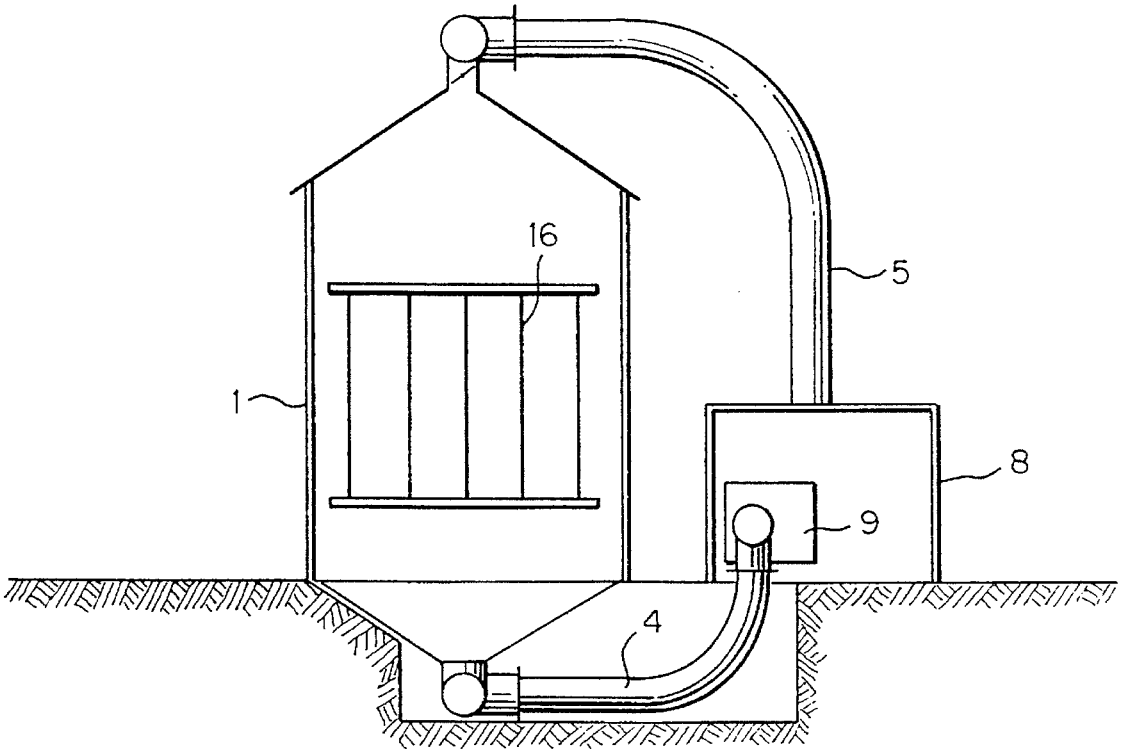
FIG. 2 is a section II—II in FIG. 1.

In FIGS. 1 and 2 the number 1 designates a housing, in which a plurality of drying rooms 2 and 3 respectively are placed in series after each other, the first mentioned type of which is intended for drying of boards, i.e. wood pieces having a-maximum thickness of 32 mm, whereas the second type is intended for the drying of planks, i.e. wood pieces having a smallest thickness of 32 mm. Each of the drying rooms 2, 3 is individually connected to a conduit 4 common to all drying rooms for the supply. of dry, warm in-take air to the drying rooms and to a conduit 5, which likewise is common to all drying rooms for evacuation of moist exhaust air from the drying rooms. In each branch conduit from the supply conduit 4 to the individual drying room 2, 3 there is a valve or a damper 6 for closing and/or regulating the flow of air into the associated drying room. Valves or dampers 7 are in an analogous manner arranged in the branch conduits leading from the respective drying rooms and connected to the evacuation conduit 5 for closing and/or regulating the flow of air out of the associated drying room. The evacuation conduit 5 is, as appears from FIG. 2, connected to a separate housing or space 8 (which per se may be built into the housing 1), in which there is arranged a diagrammatically illustrated internal combustion engine 9, which in a manner which is known by WO88/09471 comprises an exhaust pipe (not shown) included in a heat exchanger for heating air, which, after having passed through the heat exchanger, is conducted into the supply conduit 4 in the form of dry, warm in-take air to the drying rooms. Thus, the combustion air for the engine 9 is formed, in this arrangement known per se by WO88/09471, by the moist exhaust air which is evacuated from the drying rooms and which is somewhat cooled in relation to the in-take air. According to a preferred embodiment of the device according to the invention this combustion engine 9 may be used for driving an electric generator for the purpose of generating electric power which may be used for driving machinery, for instance in a sawmill (not shown) connected to the drying device. Fans for sucking the exhaust air out of the drying rooms via the evacuation conduit 5 and for blowing in-take air into the drying rooms via the supply conduit 4 are also comprised in the housing or space 8.

Figure 3:
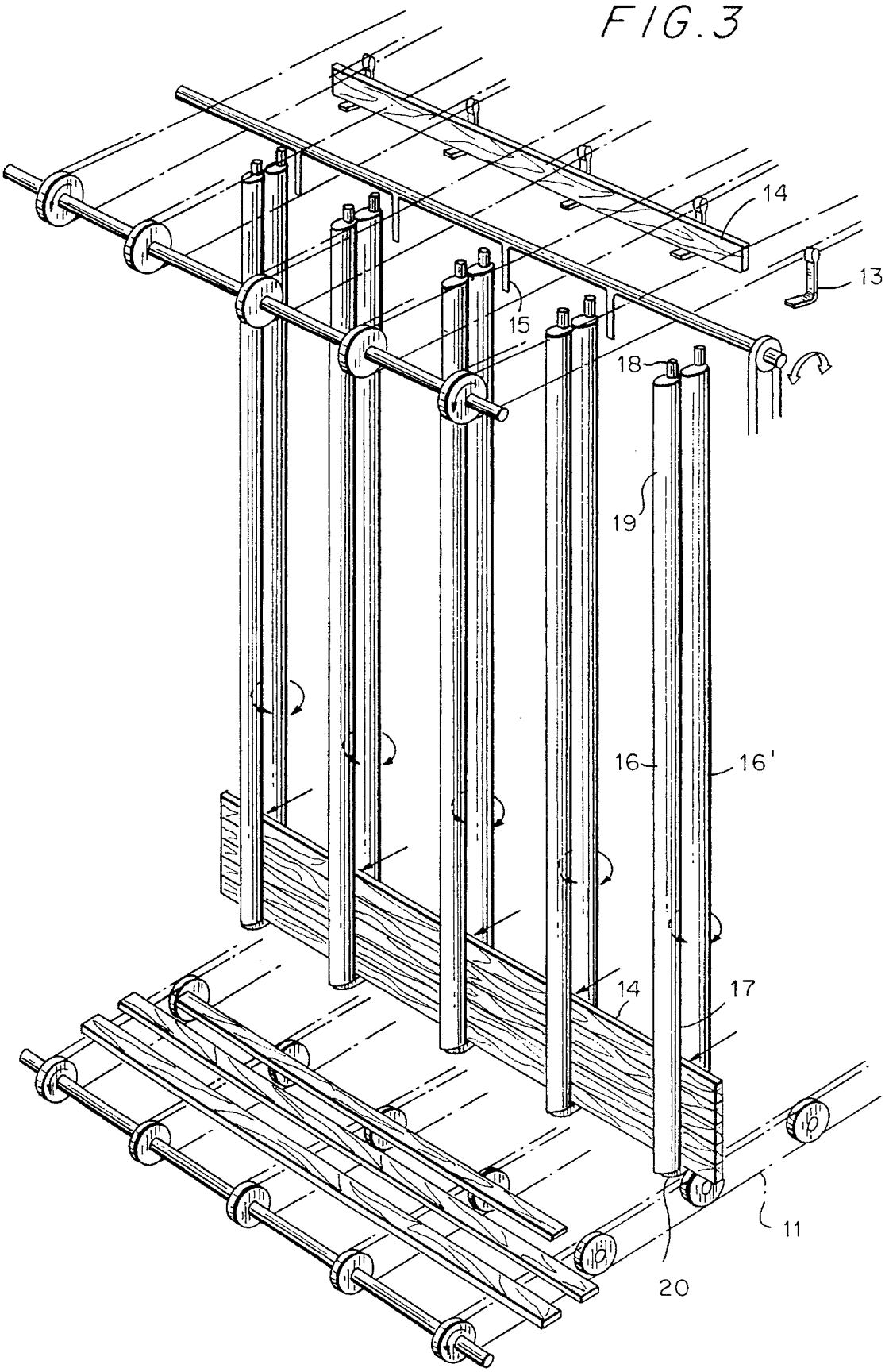
FIG. 3 is an enlarged perspective view diagrammatically illustrating a timber compartment contained in a drying room.
Figure 4:
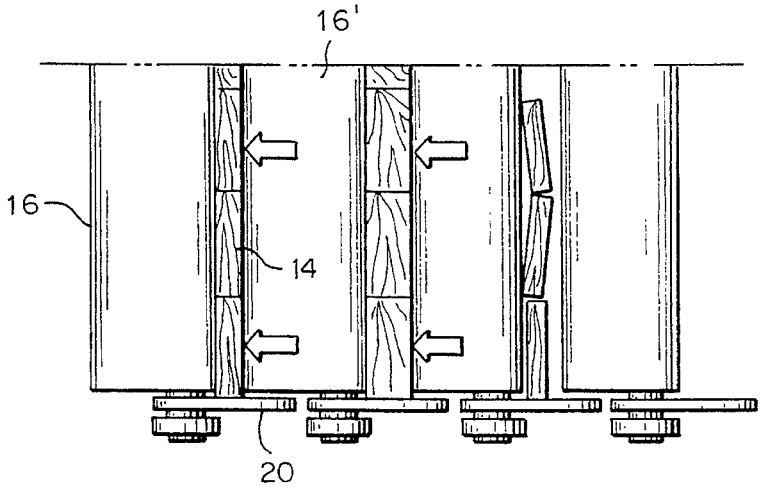
FIG. 4 is an enlarged, cut side view illustrating spacing elements defining said timber compartments.
Figure 5:
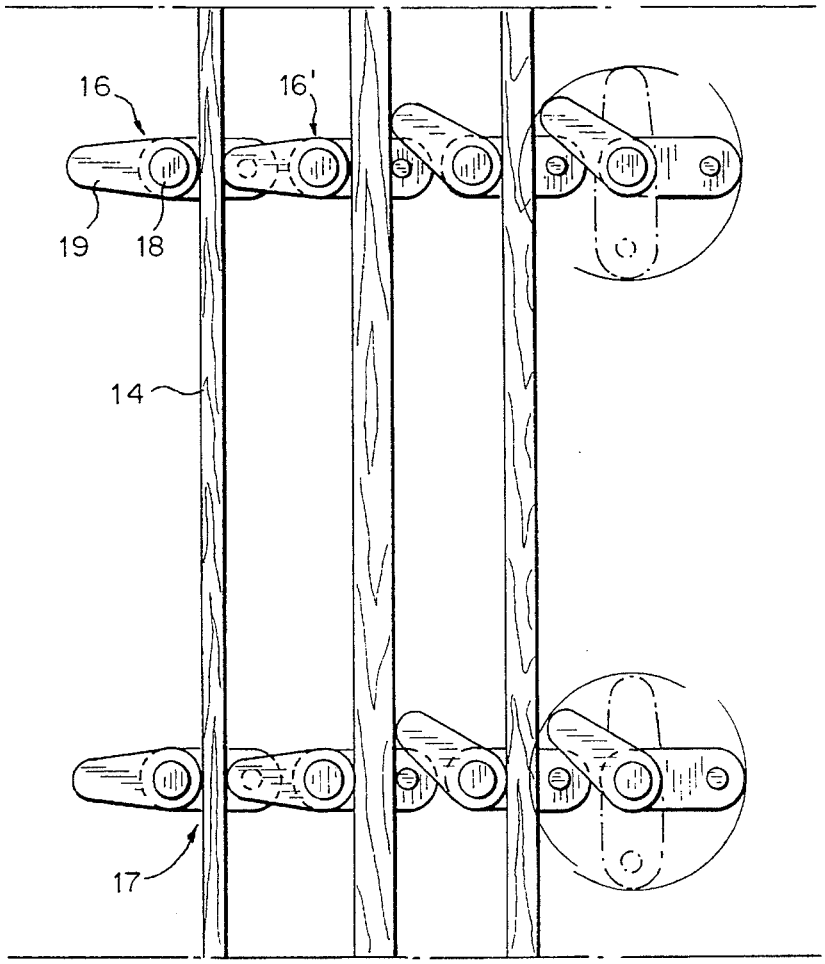
FIG. 5 is a plan view illustrating an enlarged portion of said spacing elements as viewed from above.

An upper conveyer 10 and a lower conveyer 11 are arranged in the housing 1. The upper conveyer is adapted to receive raw or undried wood pieces suitably directly from a sawmill via a feeding-out conveyer 12 therefrom. The conveyor 10 may in practise be of such known kind which comprises a number of hooks or hook shaped holders 13 (see FIG. 3) depending from a lower part of one or more endless chains, a board or plank 14 being supportable on said hooks or holders 13 and being capable of being pushed off the hooks by means of a pushing-off element 15, which is momentarily actuatable and which for instance may be in a form of a finger which may be turned downwardly. A board transported on a set of hooks 13 in a direction from the left to the right in FIG. 1 may, accordingly, be released from the hooks at a desired place along the conveyer by turning dawn a desired number of pushing-off elements at that place, whereby the board, which suitably is arranged edgeways on the hooks, falls down into an under-lying drying room.

The upper as well as the lower conveyer pass through-openings in the walls between adjacent drying rooms. In order to delimit the flows of air through the respective drying rooms from each other, these wall openings may in practise be provided with suitable sealings, for instance in the form of flexible strips or pieces fabric, which depend from the upper edges of the wall openings and which automatically are moved to the side when a wood piece is to pass during its displacement between two adjacent drying rooms.

In each individual drying room 2 and 3 respectively there are arranged several sets of spacing elements 16, 16', which are separated from each other and which delimit a plurality of separate compartments denoted 17 in FIG. 1. In the example illustrated in FIG. 3, each individual set of spacing elements comprises five sidewardly spaced elements 16, whereas also the next set comprises five elements 16'etc. Each individual element 16, 16' comprises an axle 18, on which there is arranged a profile 19 having a cross-sectionally long and narrow shape with softly rounded surfaces. In practice the profile 19 may have an oval or generally ellipsoidal shape. The axles 18 are in a suitable manner, for instance by means of a linkage system not illustrated, rotatable at least 90° to be adjusted into a position, in which the cross-sectionally flattened profiles 19 are substantially parallel to each other in two adjacent sets 16, 16', the compartment being delimited by-means of the elements having a maximum width, and a position, in which the longitudinal edge of the profile 19 has approached the adjacent element while reducing the width of the compartment. In the region of the lower ends of the elements 16, 16', there are stop members 20, which are movable between a closing position, in which the stop members may support a number of wood pieces lying on each other, and an opening position, in which the wood pieces after completed drying may fall out of the associated compartment and down on the lower conveyor 11 as a consequence of their own weight. These stop members 20 may in practise have the design of pivotable fingers, which are movable by means of a link system common to each element set 16 and 16' respectively.

The spacing elements 16, 16' extend, in the embodiment illustrated, vertically between the upper and the lower conveyors 10 and 11 respectively while delimiting vertical compartments in the respective drying rooms. It would be conceivable per se to arrange the spacing elements and the compartments delimited thereby at a certain angle to the vertical plane, provided that the compartments still are orientated upright.

The device described operates in the following manner. When an individual board or plank from the saw mill arrives from the saw mill to the drying housing 1 via the out-feed conveyor 12, the board or plank is picked up by the upper conveyor 10, more specifically by means of the hook holders 13 thereof, and transported in a direction from the left to the right according to FIGS. 1 and 3. In this condition the flattened profiles 19 in an individual drying room are so adjusted relative to each other that the distance between adjacent profiles, that is the width of the compartment, is somewhat larger that the thickness of the board in question. When the board during its displacement along the conveyor arrives to a pro-determined compartment in the drying room, the pushing-off elements 15 are activated, which involves the consequence that the board is pushed off the associated hook holders and falls down into the compartment in question. Even during this fall, the board is located edgeways so that the same, when it arrives to the bottom of the compartment and is picked up by the stop members 20, remains located edgeways. As boards are successively fed into the various compartments in a drying room the compartments are filled and when all compartments in the drying room have been completely filled with boards, the axles 18 are rotated so that the flattened profiles 19 with their free long side edges approach the adjacent sets of profiles, that is during reduction of the width of the compartments. This has the consequence that the boards in the vertically orientated board layer are clamped firmly between adjacent profiles. In this condition the drying of the boards may be started, more specifically by opening the dampers 6 and 7 to the drying room in question so as to supply the desired amount of warm and dry in-take air from the supply conduit 4 to the drying room. The in-take air thus introduced may freely pass between the different board layers between the spacing element 16, 16' and flow along the large surfaces of the boards. The air which has passed through the drying room and been moistened by the boards and cooled somewhat, although it still has a relatively high temperature, is evacuated via the conduit 5 and conducted to the combustion engine 9 in which the air is taken in as combustion air. The exhaust gases from the engine is caused to pass, in a manner known per se, through a heat exchanger, in which dry fresh air is taken in from outdoors and is heated by exhaust gases to be transported to the supply conduit 4 in order to be supplied to the drying room in question.

When the drying of a charge of boards in a drying room has been terminated, the spacing element 16, 16' are rotated back to their starting positions, whereby the clamping action of the elements ceases. In the next step the stop members 20 are moved to the side, whereby the dried boards may fail down on the lower conveyer 11 and be transported out of the housing by means of said conveyer to a packaging station following thereafter.

The advantages of the invention are obvious. Since the boards or planks are maintained clamped in a fixed state during drying, all deformation thereof is avoided in an efficient manner. Furthermore, the need for loose stickers between board layers is completely eliminated. Another advantage is that the energy consumption for carrying out the drying may be radically decreased in view of the fact that the exhaust air, which is still relatively warm after a drying operation, is not evacuated directly into the free air but is caused to pass through a combustion engine and a heat exchanger connected thereto, the engine being useful in a preferable manner for generation of electric power for machinery, for instance in an associated sawmill.

It is evident that the invention is not only restricted to the embodiment described and diagrammatically illustrated in the drawings. Thus, it is conceivable to change the width of the drying compartments in other manner than by rotating flattened spacing elements, for instance by composing each individual spacing element of two parts movable relative to each other, said parts being capable of being moved towards and away from each other respectively while increasing and decreasing respectively the width of the board compartment for the purpose of allowing reception of freely movable boards and enable clamping of the boards during a drying operation. Although it is preferred to use a combustion engine for heating the in-take air to the drying room in a manner known by WO88/09471, it is in practise possible to recover the heat contents of the exhaust air by means of heat exchangers of a conventional or other nature. Furthermore, it is to be pointed out that the individual drying rooms with preference may be completed with a closable or regulatable fresh air in-take at their lower pads. Through such an intake fresh air may be introduced into the drying room after completed drying and after closing of the associated warm air damper 6 so as to cool the boards whereas the heat contents of the exhaust air still may be recovered by means of a heat exchanger. The upper as well as the lower conveyer in the device may of course be modified in many ways. The examples given are, accordingly, only intended to illustrate the concept of the invention. in principle without being intended to delimit the same in any way. In this connection it is pointed out that at least the upper conveyer may be controlled by a computer, into which data concerning the quality and dimensions of the wood pieces are fed already in a sorting station in the saw mill connected to the drying device. It is preferable that the compartments (17) are open at their upper ends in a direction upwardly to receive the wood pieces from above.

I claim:

1. A method for drying timber, comprising treatment of elongated wood pieces, with dry warm air during storage thereof in a drying room (2, 3) and maintaining individual wood pieces (14) having a thickness, a length, and a width, separated from each other during the drying by means of upright, vertical, spacing elements (16, 16') engaged within the drying room for repeated use without replacement, characterized in that the wood pieces (14) are fed edgewise down into upright, vertically directed, compartments (17) having a width defined by the spacing elements (16, 16') by means of a conveyor (10), present above each compartment of the compartments so as to form a layer of said wood pieces perpendicular to a base of said drying room in each said compartment, said layer comprising the wood pieces abutting each other along longitudinal edges thereof.

2. A method according to claim 1, characterized in that the spacing elements (16, 16') are caused to clamp the wood pieces in a fixed condition, in which deformation thereof is counteracted.

3. A method according to claim 2, characterized in that each said compartment (17) is delimited by means of at least two separated sets of movable spacing elements, that the spacing elements (16, 16') in connection with a in-feed of the wood pieces are held in a position, in which a width of the compartment (17) is larger than a cross-sectional dimension, of the wood pieces and that the spacing elements after a terminated in-feed of a desired number of the wood pieces in the compartment are moved or adjusted into positions, in which the width of the compartment is reduced, so that the spacing elements in said at least two separated sets simultaneously engage and clamp the wood pieces.

4. A method according to claim 3, characterized in that the spacing elements are adjusted by rotation.

5. A method according to claim 1, characterized in that the spacing elements (16, 16') during the in-feed of the wood pieces into the compartment are held adjusted into a state in which the width of the compartment is larger than the thickness of flat wood pieces but smaller than the width thereof, so as to orientate the wood pieces edgeways in the compartment.

6. A method according to claim 1, characterized in that the wood pieces after drying are fed out through an opening in a lower part of each said compartment (17) and that while fed out the wood pieces are controlled by means of at least one stop member (20) arranged in connection with the opening in the compartment.

7. A method according to claim 6, characterized in that the stop member (20) is movable between a closing position in which the stop member may carry a plurality of wood pieces lying on each other during in-feed thereof, and an opening position in which the wood pieces after drying has been completed may fall out of the compartment as a consequence of their own weight.

8. A method according to claim 6, characterized in that the wood pieces, after drying has been completed, are received from the compartments and transported out of the drying room by means of a conveyor (11) arranged under the compartments (17).

9. A device for drying timber in the form of elongated wood pieces, comprising one or several drying rooms, (2, 3) and means (4, 5) to introduce relatively dry and warm intake air into the drying rooms and evacuate more moist and colder exhaust air out therefrom, several sets of elongated, upright, vertical spacing elements (16, 16') being engaged within each drying room of said drying rooms (2, 3) for repeated use without replacement, said sets being separated relative to each other and said spacing elements defining a plurality of separate compartments (17) in the drying rooms, characterized in that the spacing elements (16, 16') define upright, vertical, compartments (17), above which a conveyor (10) for feeding the wood pieces to each compartment of said compartments is arranged so as to form a layer of said wood pieces perpendicular to a base of said drying rooms, said layer comprising the wood pieces abutting each other along longitudinal edges thereof.

10. A device according to claim 9, characterized in that the spacing elements (16, 16') are movable so as to be adjustable between a first position, in which a width of each said compartment is larger than a cross-sectional dimension of the wood pieces so as to allow unobstructed feeding thereof into the compartment, and a second position, in which the width of the compartment has been reduced so that the spacing elements (16, 16') in two adjacent sets contact and clamp the wood pieces so as to counteract deformation thereof during drying.

11. A device according to claim 10, characterized in that the spacing elements (16, 16') are rotatably arranged to be adjustable by rotation.

12. A device according to claim 9, characterized in that each individual compartment-delimiting set of spacing elements comprises a plurality of long and narrow spacing elements (16, 16'), which are separated from and parallel to each other to admit free flow of air between adjacent timber compartments.

13. A device according to claim 9, characterized in that at least one stop member (20) is is arranged in connection with an opening in a lower part of each said compartment.

14. A device according to claim 13, characterized in that the stop member (20) is movable between a closing position, in which it is capable of supporting a plurality of wood pieces lying on each other during in-feed thereof, and an opening position in which the wood pieces after completed drying may fall out of each said compartment as a consequence of their own weight.

15. A device according to claim 13, characterized in that a conveyor (11) is arranged under the compartments (17) to receive the wood pieces under the compartments after completed drying and transport the wood pieces out of the dry rooms to a packaging station.

16. A device according to claim 9, characterized in that it comprises a plurality of drying rooms (2, 3) placed in a series after each other, said drying rooms being each connected to a conduit (4) common to all the drying rooms to supply dry in-take air to the drying rooms and to a conduit (5) likewise common to all drying rooms for evacuation of more moist exhaust air from the drying rooms, and that valves (6, 7) for closing and regulating a flow of air into and out of the respective drying rooms are arranged between, on one hand, each individual drying room (2, 3) and, on the other hand, said supply conduit (4) as well as said evacuation conduit (5).

17. A device according to claim 16, characterized in that the evacuation conduit (5) conducts moist exhaust air from the drying rooms (2, 3) as combustion air to a combustion engine (9) which comprises an exhaust pipe included in a heat exchanger for heating air which, after having passed through the heat exchanger, is conducted into said supply conduit in the form of in-take air to the drying rooms.

18. A device according to claim 17, characterized in that the combustion engine (9) is adapted to drive an electric generator to generate electrical power, which may be used to drive machinery connected to the drying device.

19. A method according to claim 4, characterized in that the wood pieces after drying are fed out through an opening in a lower part of each said compartment (17) and that while fed out the wood pieces are controlled by means of at least one stop member (20) arranged in connection with the opening in the compartment.

20. A method according to claim 19, characterized in that the wood pieces, after drying has been completed, are received from the compartments and transported out of the drying room by a means of a conveyor (11) arranged under the compartments (17).

* * * * *